US008347434B2

(12) United States Patent
Chan et al.

(10) Patent No.: US 8,347,434 B2
(45) Date of Patent: Jan. 8, 2013

(54) AIR-OPERATED DEVICE FOR BETTER SLEEP

(75) Inventors: Jui-Peng Chan, Changhua (TW); Hsi-Chuan Huang, Changhua (TW)

(73) Assignee: Trinity Biotech Co., Ltd., Changhua (TW)

( * ) Notice: Subject to any disclaimer, the term of this patent is extended or adjusted under 35 U.S.C. 154(b) by 26 days.

(21) Appl. No.: 13/069,841

(22) Filed: Mar. 23, 2011

(65) Prior Publication Data

US 2011/0283460 A1 Nov. 24, 2011

(30) Foreign Application Priority Data

May 21, 2010 (TW) ..... 99116368 A

(51) Int. Cl.
*A47G 9/10* (2006.01)

(52) U.S. Cl. ..... 5/636; 5/640; 5/644; 5/645

(58) Field of Classification Search ..... 5/636, 639, 5/640, 641, 644, 645
See application file for complete search history.

(56) References Cited

U.S. PATENT DOCUMENTS

| | | | | |
|---|---|---|---|---|
| 4,941,478 | A * | 7/1990 | Takeuchi et al. | 128/848 |
| 5,184,365 | A * | 2/1993 | Stafford | 5/632 |
| 5,708,999 | A * | 1/1998 | Priolo et al. | 5/644 |
| 5,940,913 | A * | 8/1999 | Horowitz | 5/640 |
| 6,317,908 | B1 * | 11/2001 | Walpin | 5/636 |
| 7,195,660 | B2 * | 3/2007 | Little et al. | 55/385.1 |
| 7,676,870 | B2 * | 3/2010 | Chen | 5/640 |
| 2009/0094750 | A1 * | 4/2009 | Oguma et al. | 5/636 |
| 2012/0079660 | A1 * | 4/2012 | Chen | 5/644 |

* cited by examiner

*Primary Examiner* — Michael Trettel
(74) *Attorney, Agent, or Firm* — Wang Law Firm, Inc.; Li K. Wang; Stephen Hsu

(57) ABSTRACT

An air-operated device for better sleep includes a pad whose inside has an interlayer composed of two sheets stacked together. The top surface of the pad has an accommodating cavity in communications with the interlayer. The pad has an air vent. Two airbags are disposed adjacently in the accommodating cavity. The airbags are in touch with the interlayer by the adjacent side. The airbags are connected to the air vent of the pad via an air-transporting pipe, respectively. An action pad is disposed correspondingly in the accommodating cavity and depresses the two airbags. A controller is connected to the air vent of the pad to inflate and deflate the airbags. When the airbags are inflated, the action pad is pushed by the air bags to sway upward.

10 Claims, 10 Drawing Sheets

AIR-OPERATED DEVICE FOR BETTER SLEEP

BACKGROUND OF THE INVENTION

1. Field of Invention

The invention relates to a better sleep device and, in particular, to an air-operated device for better sleep.

2. Related Art

Sleep is very important for human beings. However, modern people generally suffer from insomnia to various extents. The quality of sleep has a direct relation with pillow. Therefore, there are memory pillows made of soft rubber, foam materials, or even special foams. Such pillows provide more support compliant with human body engineering. So users can enjoy better sleep. However, the effects provided by the above-mentioned pillows are passive. That is, they cannot provide massages for the user before they fall asleep. Therefore, the effects are limited.

SUMMARY OF THE INVENTION

An objective of the invention is to provide an air-operated device for better sleep. It can provide massages and soothing and relaxing effects before its user falls asleep. Moreover, the invention can effectively promote sleep quality so that users can readily fall asleep and enjoy better sleep quality. When the invention senses snore from the user, it automatically pushes to turn the user's head toward the other side, thereby changing the user's sleeping gesture. This will make the user's respiratory tract smoother, and effectively stops the annoying snore.

To achieve the above-mentioned objective, the disclosed air-operated device includes a pad, two airbags, an action pad, and a controller.

The pad has a bottom surface and a top surface. The interior of the pad has an interlayer composed of two sheets stacked together. The top surface thereof has an accommodating cavity in communications with the interlayer. Both sides of the accommodating cavity are formed with recesses connected to the interlayer. The two recesses accommodate a microphone, respectively. The power lines of the two microphones are electrically connected to a node on the outer side of the pad via the interior thereof. An air vent is formed at a predetermined position on the outer side of the pad.

The two airbags are adjacently disposed in the accommodating cavity, and connected to the interlayer by their adjacent side. The two airbags have an air pipe, respectively, connected to the air vent of the pad via the space between the two sheets of the interlayer.

The action pad is correspondingly disposed in the accommodating cavity, and depresses the two airbags. The controller has two air-transporting pipe and an insertion terminal corresponding to the node. The controller is externally connected to the air vent of the pad via the air-transporting pipes. The controller has a pump inside. By controlling the pump, the controller can inflate or deflate the two airbags. When the airbags are inflated, the action pad is pushed by the airbags to sway upward. The controller is electrically connected to the node on the pad via the insertion terminal thereof. When one of the microphones senses sound, the controller can be set to inflate one of the airbags.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
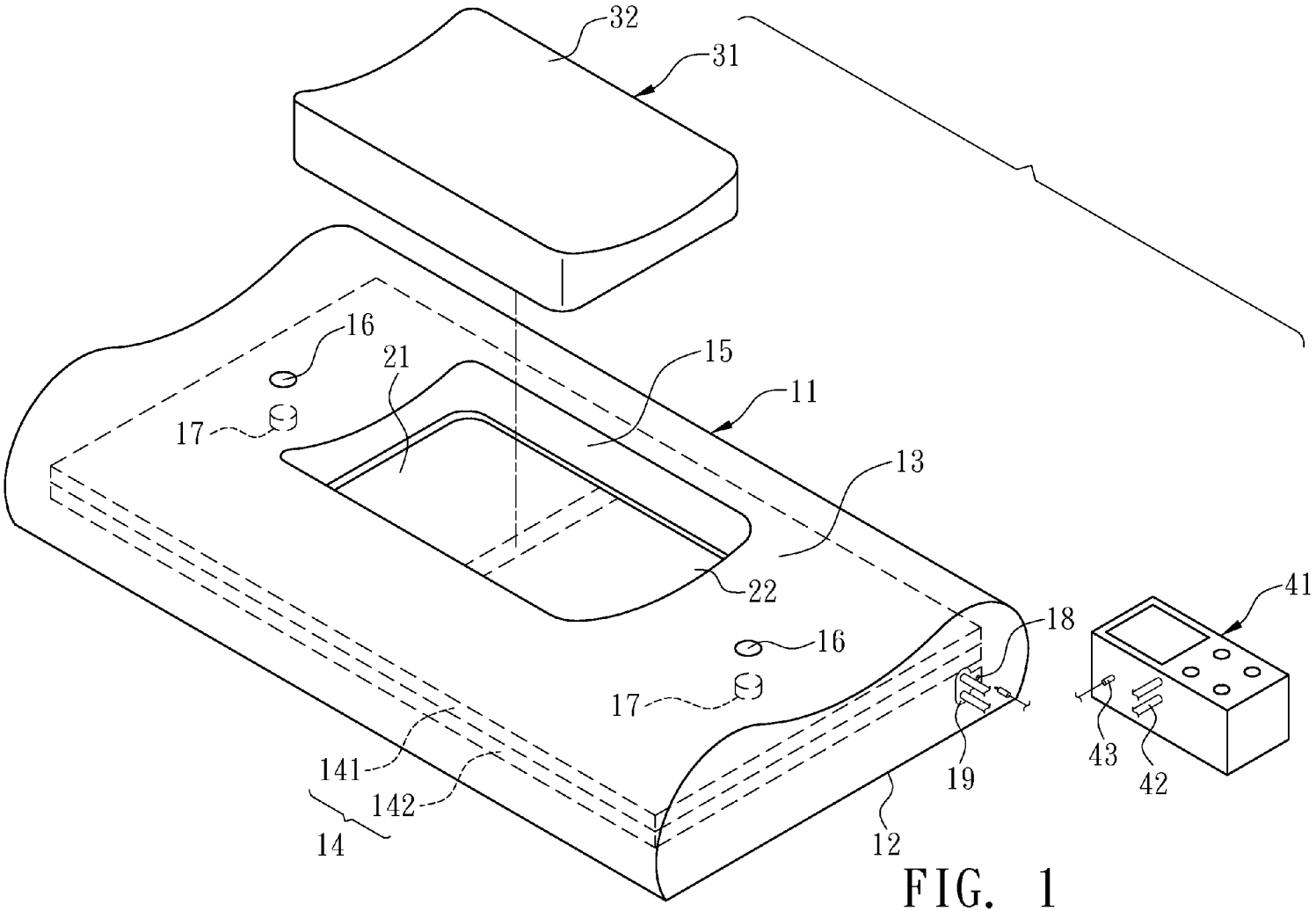
FIG. 1 is a three-dimensional exploded view of the first embodiment of the invention.
Figure 2:
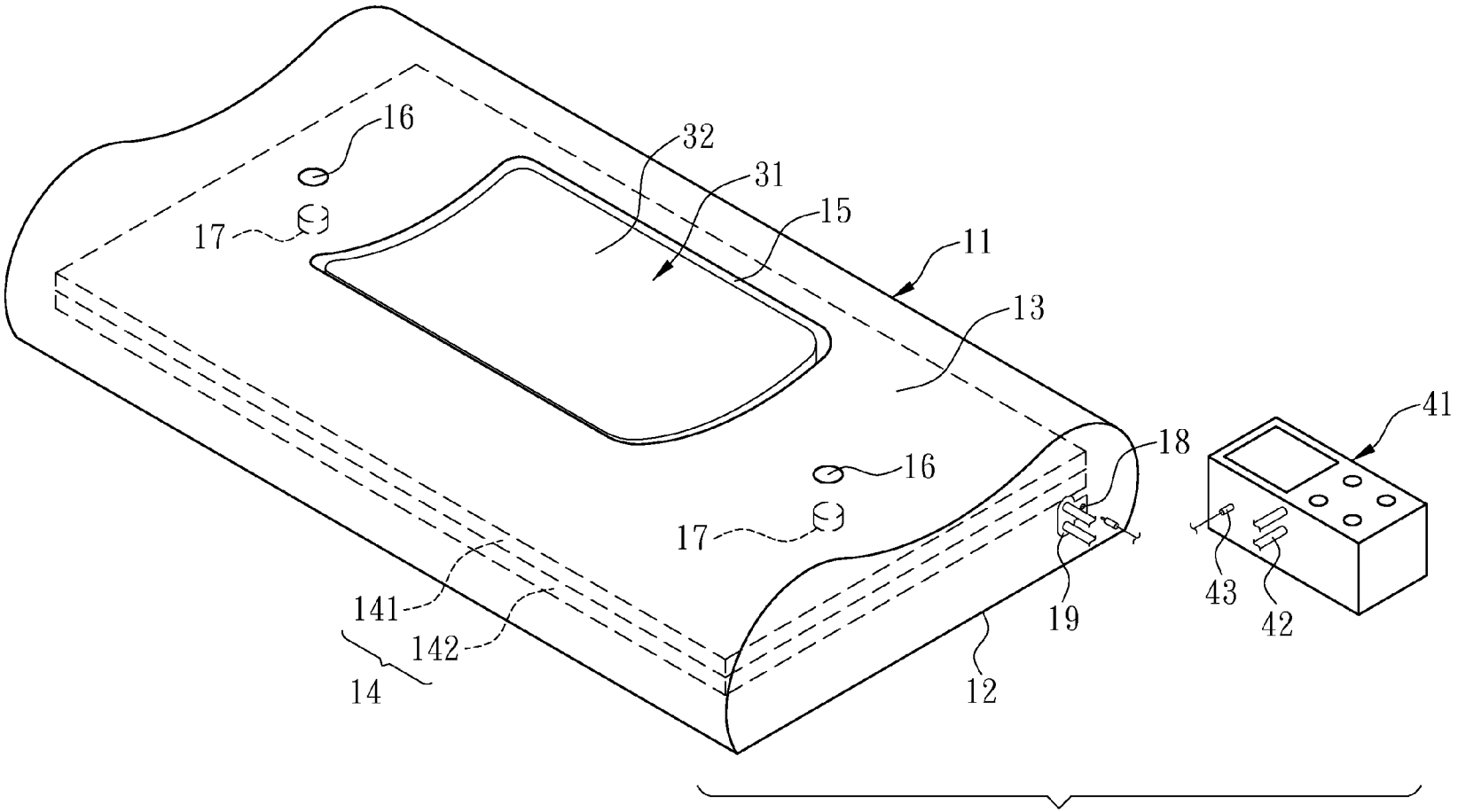
FIG. 2 is a three-dimensional view of the first embodiment.

Please refer to FIG. 1 for a first embodiment of the disclosed air-operated device for better sleep. The invention includes a pad 11, two airbags 21, an action pad 31, and a controller 41.

The pad 11 is made of a foam material. The pad 11 has a bottom surface 12 and a top surface 13. The interior of the pad 11 has an interlayer 14 composed of two sheets 141, 142 stacked together. During the formation of the pad 11, the center of the top surface 13 is formed with an accommodating cavity 15 with an upward opening and connected to the interlayer 14. Both sides of the accommodating cavity 15 on the top surface 13 of the pad 11 have recesses 16 connected to the interlayer 14. The two recesses 16 accommodate a microphone 17, respectively. The power lines (not shown) of the two microphones 17 electrically connect to a node 18 on the outer side of the pad 11 via the space between the interlayer 14 and the pad 11. Of course, the power lines of the microphones 17 are covered by insulating pipes to avoid direct contact with the interlayer 14 and the inner edge of the pad 11. An air vent 19 is formed at a predetermined position on the outer side of the pad 11. In this embodiment, the pad is a foam pillow. The top surface 13 of the pad 11 is formed to be a concave surface.

The two airbags 21, 22 are adjacently disposed in the accommodating cavity 15, and connected to the interlayer 14 by their adjacent side. The two airbags 21, 22 have an air pipe (not shown), respectively. The air pipes of the two airbags 21, 22 are connected to the air vent 19 of the pad 11 via the space between the two sheets 141, 142 of the interlayer 14. The air pipes are disposed between the sheets 141, 142 of the interlayer 14 to effectively remove possible discomfort when the user lies thereon and to enhance the support. Likewise, the power lines of the microphones 17 are electrically connected to the node 18 on the outer side of the pad 11 via the space between the sheets 141, 142 of the interlayer 14.

The action pad 31 is correspondingly disposed in the accommodating cavity 15. The action pad 31 depresses on the two airbags 21. In this embodiment, the action pad 31 is also made of a foam material. The top surface of the action pad 31 is formed with a concave surface 32 corresponding to the pad 11.

The controller 41 has two air-transporting pipes 42 and an insertion terminal 43 corresponding to the node 18. The controller 41 is connected to the air vent 19 of the pad 11 via the air-transporting pipes 42. There is a pump (not shown) inside the controller 41. The controller 41 can control the pump to inflate or deflate the two airbags 21, 22. When the two airbags 21, 22 are inflated, the action pad 31 is pushed by the two airbags 21, 22 to sway upward. Moreover, the controller 41 further externally and electrically connects to the node 18 of the pad 11 via the insertion terminal 43 thereof. When one of the microphones 17 senses sound, the controller 41 is set to start one of the airbags to inflate. Since the controller 41 and the pad 11 are separate, the user is prevented from electromagnetic wave interference during the operation of the controller 41.

Figure 3:
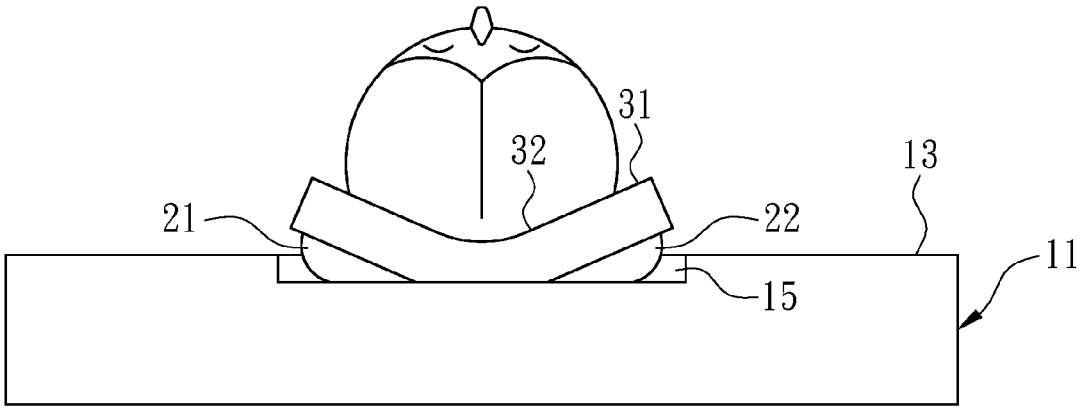
FIG. 3 is a schematic view of the first embodiment in use, showing the state of inflating both airbags at the same time.
Figure 4:
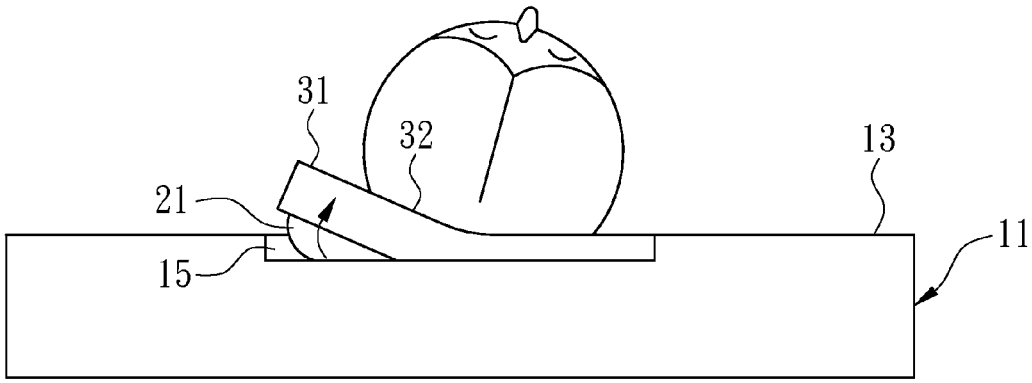
FIG. 4 is a schematic view of the first embodiment in use, showing the state of inflating only one of the airbags.

In practice, the controller 41 of the invention can be set to have different action conditions according to user's needs. Since circuit setting belongs to the prior art, it is not further addressed herein. According to the conditions, the controller 41 can simultaneously inflate the two airbags 21, 22 when the user is about to sleep. As shown in FIG. 3, the user's head is elevated by the action pad 31 pushed to have a V-shape by the two airbags 21, 22. The left and right sides of the back head of the user are thus squeezed and massaged. During the elevation of the action pad 31, the user's neck is stretched at the same time. When the controller 41 alternately inflates the two airbags 21, 22, one of the airbags 21 pushes one side of the action pad to sway upward. The user's head is thus turned to the other side. Since the action pad 31 can alleviate the pushing force due to the inflation/deflation of the two airbags 21, 22, the invention can have a slow and smooth motion (FIG. 4). The blood circulation in the head, neck, and shoulder of the user is smoother. This can prevent sore or numb feelings and stiff neck. Using the invention, the user can receive massage and get relaxed emotionally and physically. It is thus easier for the user to obtain good sleep quality.

Figure 5:
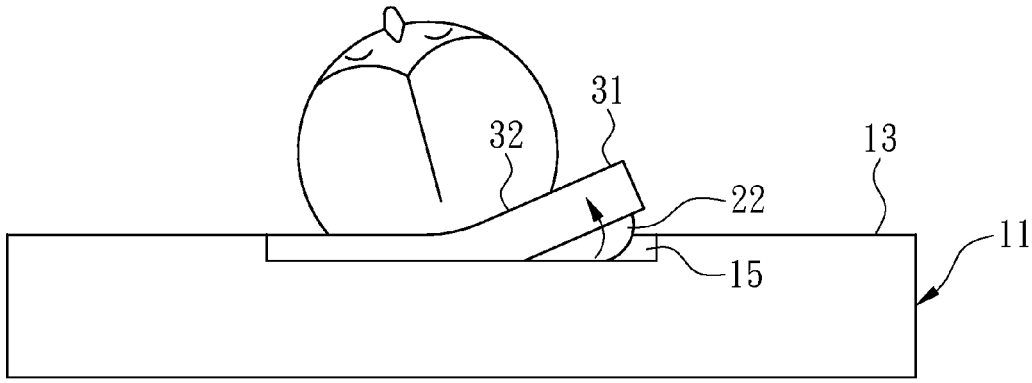
FIG. 5 is a schematic view of the first embodiment in use, showing that the controller starts to inflate the corresponding airbag when one microphone senses snore.

If the user starts to snore after falling asleep, the invention has the microphones 17 to sense the sound. The controller 41 correspondingly starts inflating the airbags 21, 22, as shown in FIG. 5. When one of the airbags 22 pushes one side of the action pad 31 to sway upward, the user's head is turned to the other side to change the gesture. By slowly adjusting the head and shoulder muscles, the user's respiratory tract becomes smoother, thereby stopping the annoying snore from affecting the sleep quality of the user and the person beside.

Moreover, the pad 11 and the action pad 31 can be added with certain pleasing flavor or materials that release ions during their fabrication. This helps improving the sleep quality.

Figure 6:
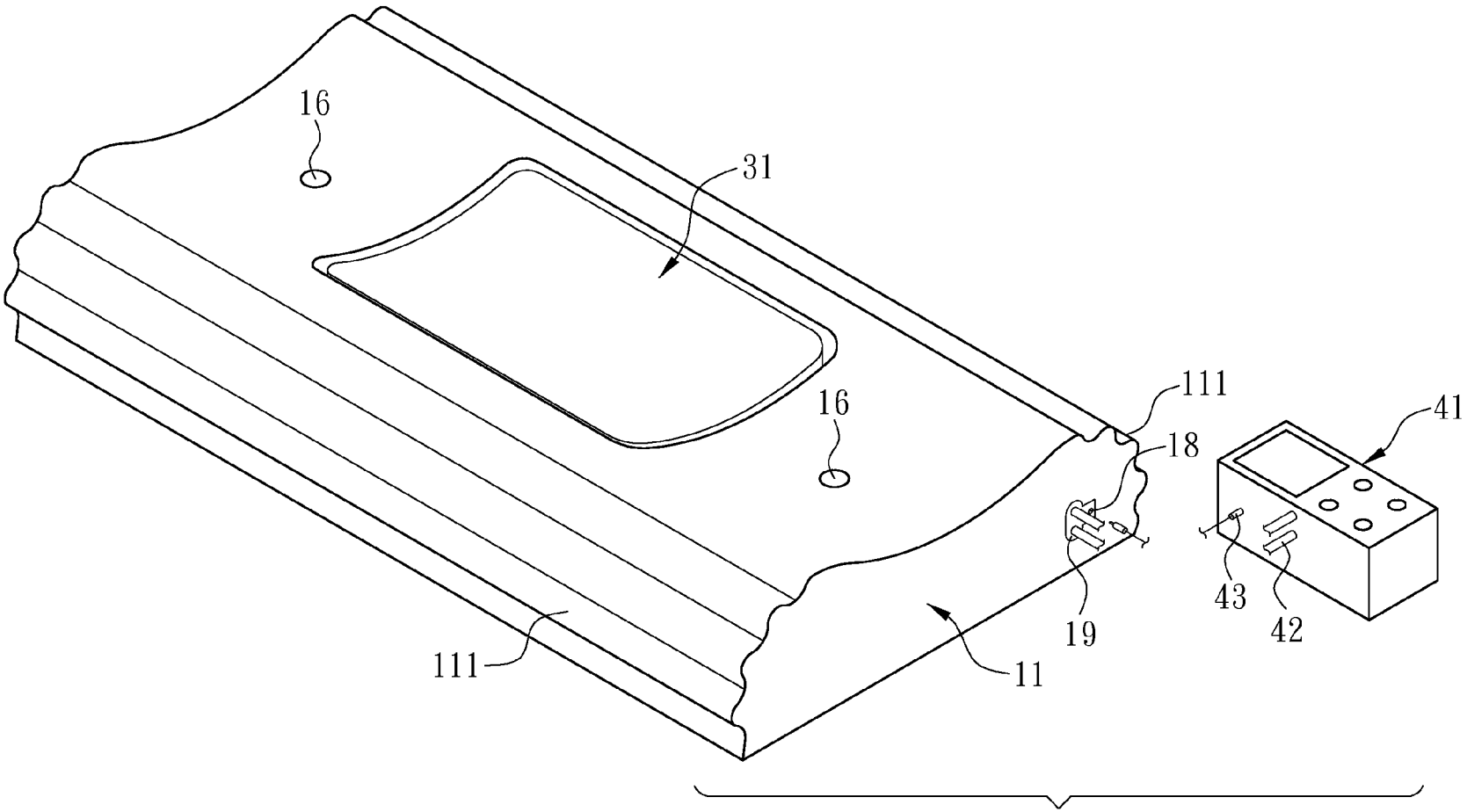
FIG. 6 is a three-dimensional view of the second embodiment of the invention.
Figure 7:
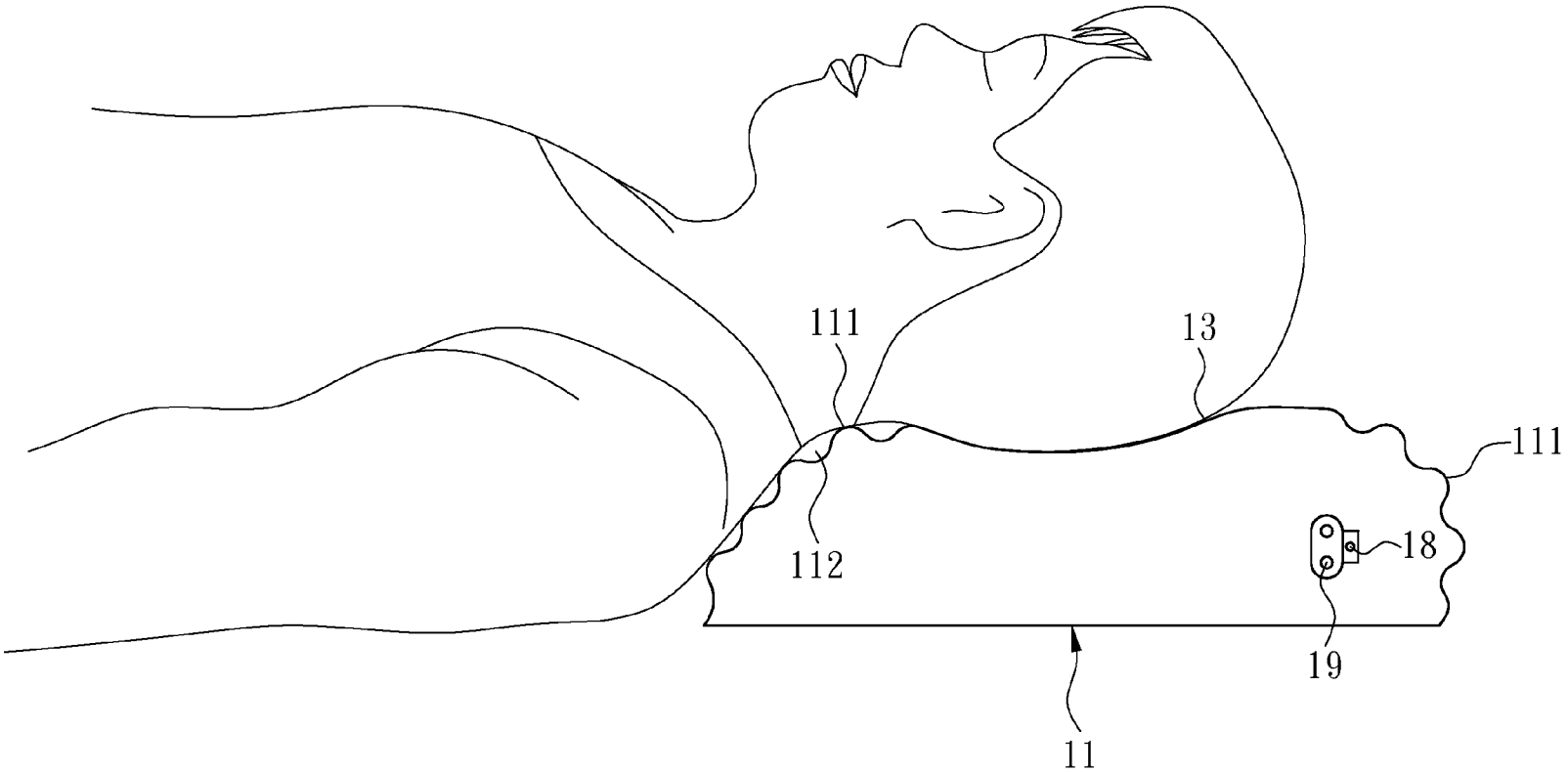
FIG. 7 shows the second embodiment in use.

Please refer to FIG. 6 for a second embodiment of the invention. This embodiment differs from the first embodiment in that the curved convex surfaces at front and rear ends of the pad 11 are further formed with wavy, transverse protruding stripes 111. When the user's head lies on the pad 11, as shown in FIG. 7, the neck is supported by the protruding stripes 111, with several vent passages 112 formed in between. Therefore, the heat produced by the user's head can readily go out of the pillow to improve sleep quality.

Figure 8:
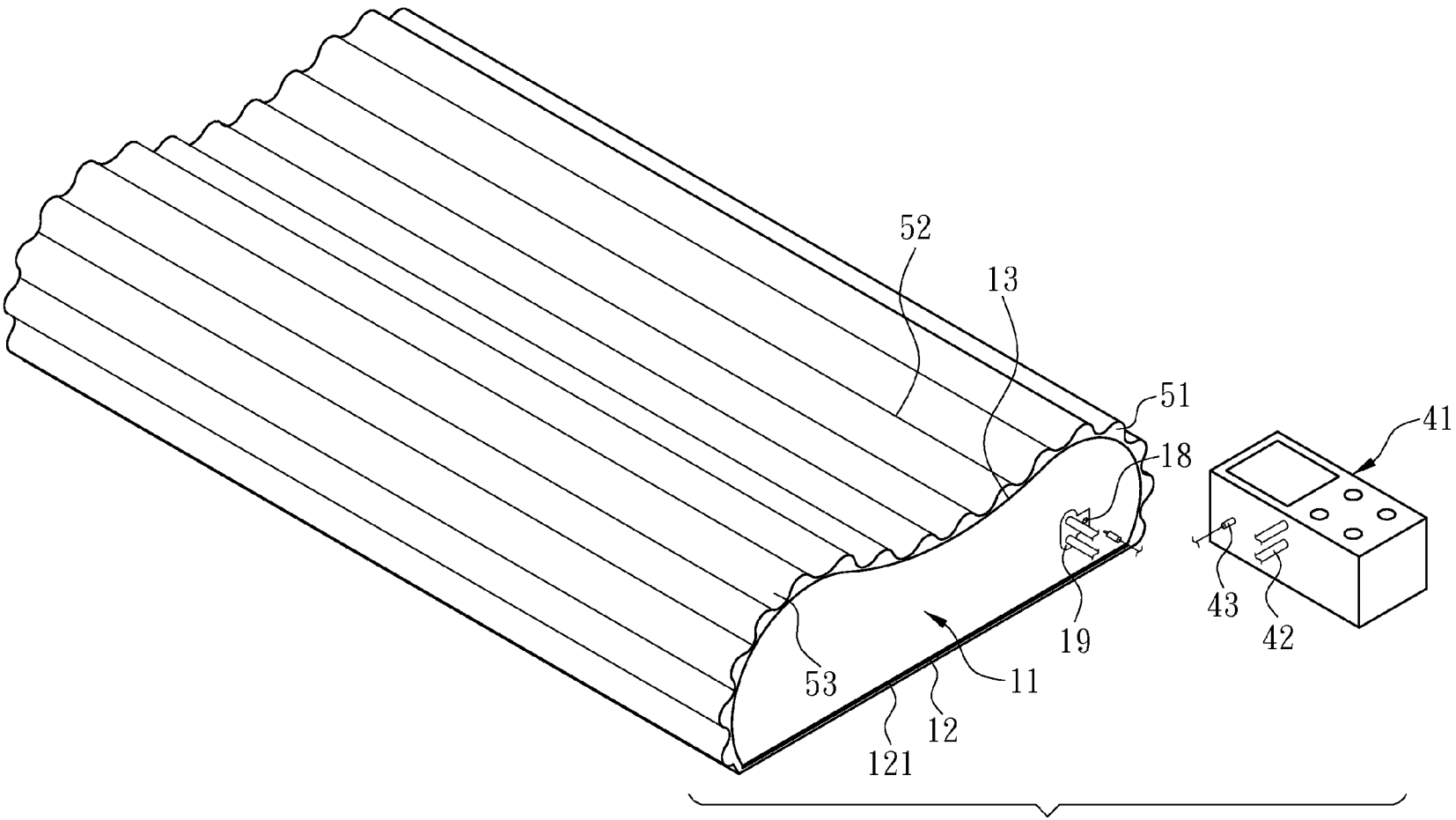
FIG. 8 is a three-dimensional view of the third embodiment of the invention.

FIG. 8 shows a third embodiment of the invention. It differs from the first embodiment in that the bottom surface 12 of the pad 11 has a structure of loops and hooks strap 121. One end of a covering body 51 is attached to the loops and hooks strap 121 at the bottom of the pad 11. The other end covers the top surface 13 of the pad 11 along the front end thereof. The top surface of the covering body 51 has wavy and transverse protruding stripes 52. When the user's head lies on the pad 11, several vent passages 53 are formed between the head and the protruding stripes 52 for venting heat and air. Furthermore, as the covering body 51 covers the pad 11, both sides thereof are hollow. Therefore, it does not affect or limit the action of the action pad during the push.

Figure 9:
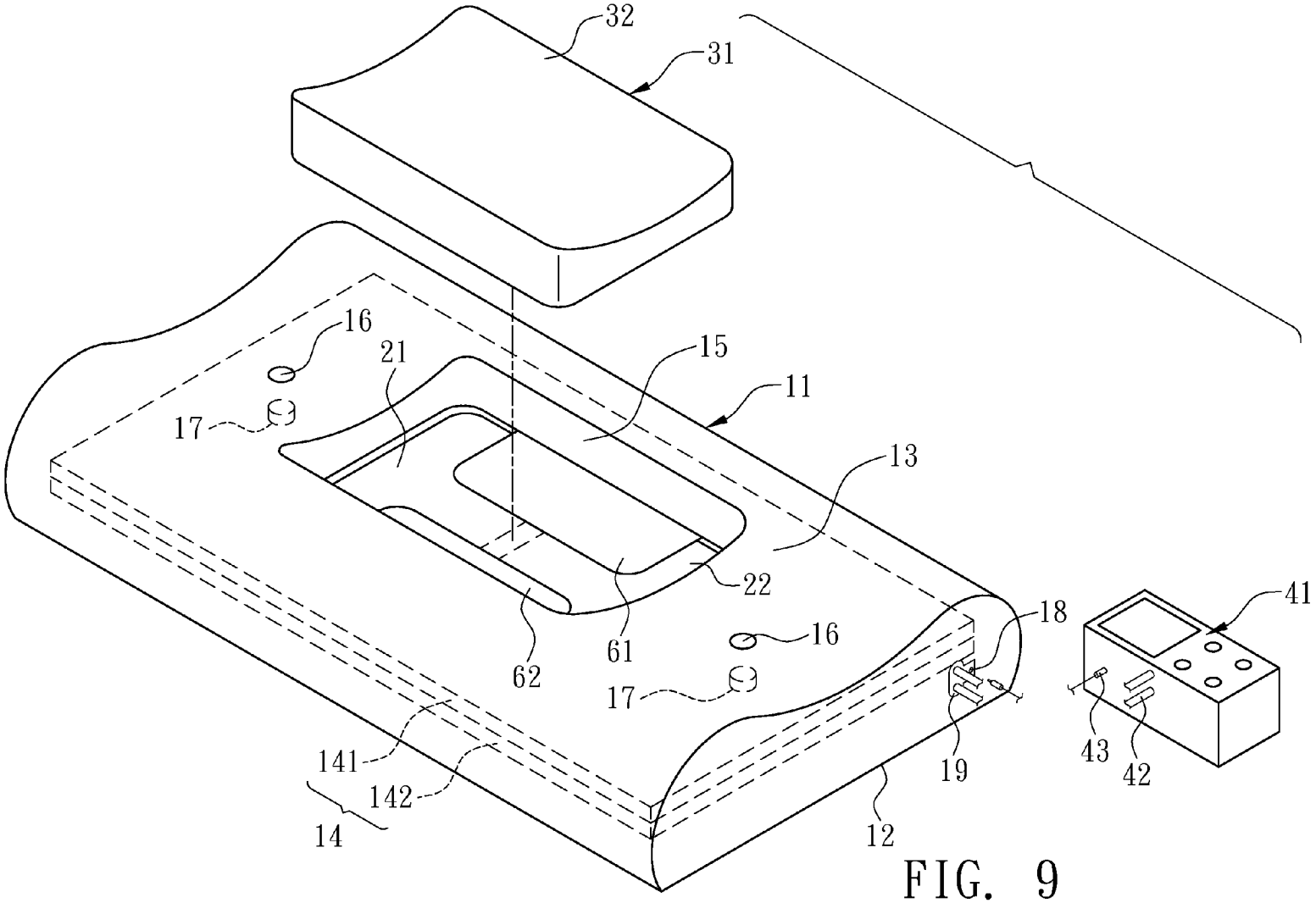
FIG. 9 is a three-dimensional view of the fourth embodiment of the invention.
Figure 10:
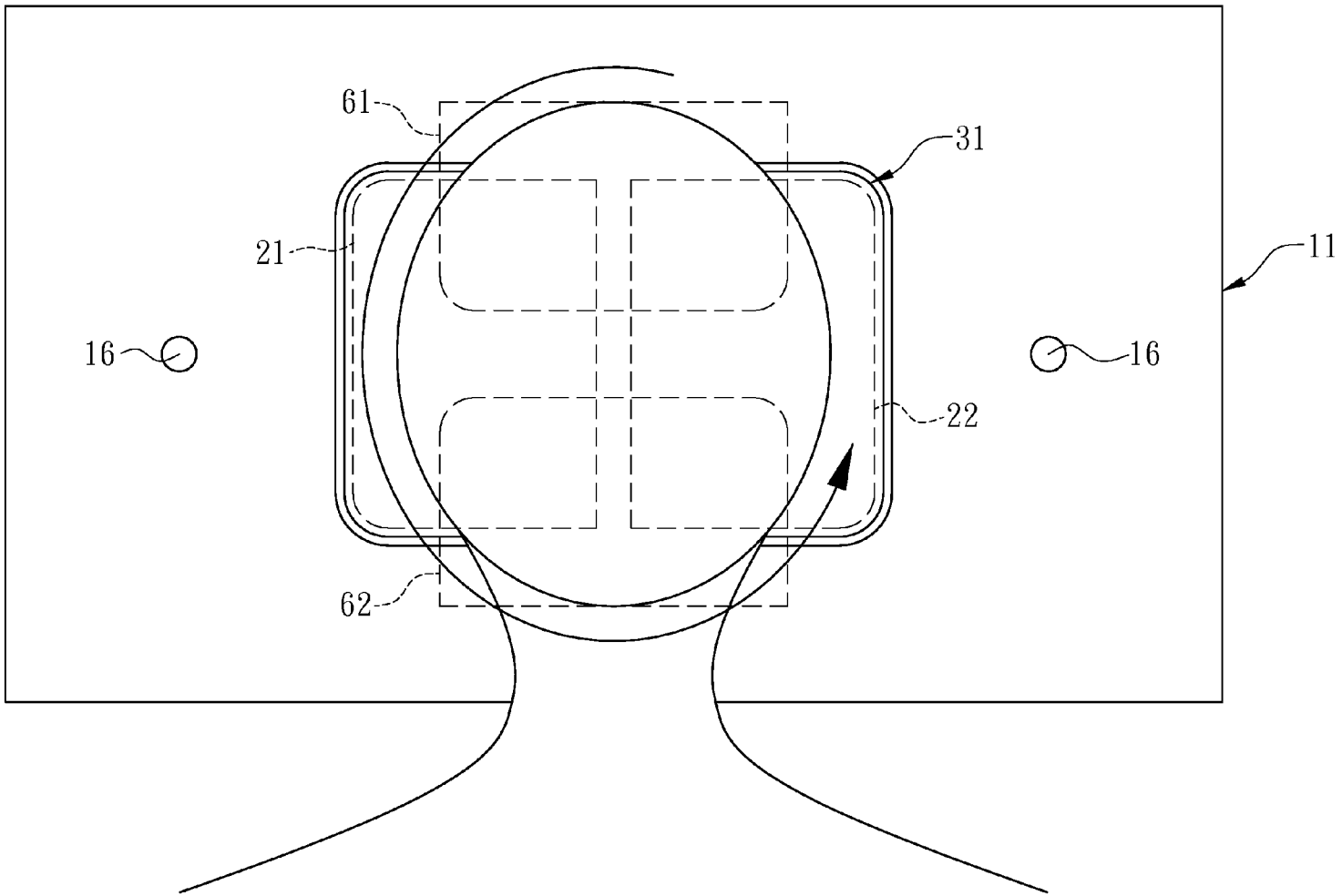
FIG. 10 shows the fourth embodiment in use.

FIG. 9 shows a fourth embodiment that differs from the first embodiment in that the accommodating cavity 15 of the pad 11 has two second airbags 61, 62. The two second airbags 61, 62 are disposed in a vertical way in the accommodating cavity 15, between the two airbags 21, 22 and the action pad 31. The two second airbags 61, 62 are connected to the interlayer 14 via the farther upper and lower sides thereof. The two second airbags 61, 62 also have an air pipe (not shown) connected to the air vent 19 of the pad 11, respectively, and are likewise controlled by the controller 41 to inflate or deflate. During the operation of the embodiment, the controller 41 controls the action of the two second airbags 61, 62. The two second airbags then push the action pad 31 to sway the head. As shown in FIG. 10, when the controller 41 is set to inflate and deflate the airbags 61, 21, 62, 22, the user's head is pushed smoothly to rotate along a circumference, achieving a more thorough relaxation for neck muscles.

Figure 11:
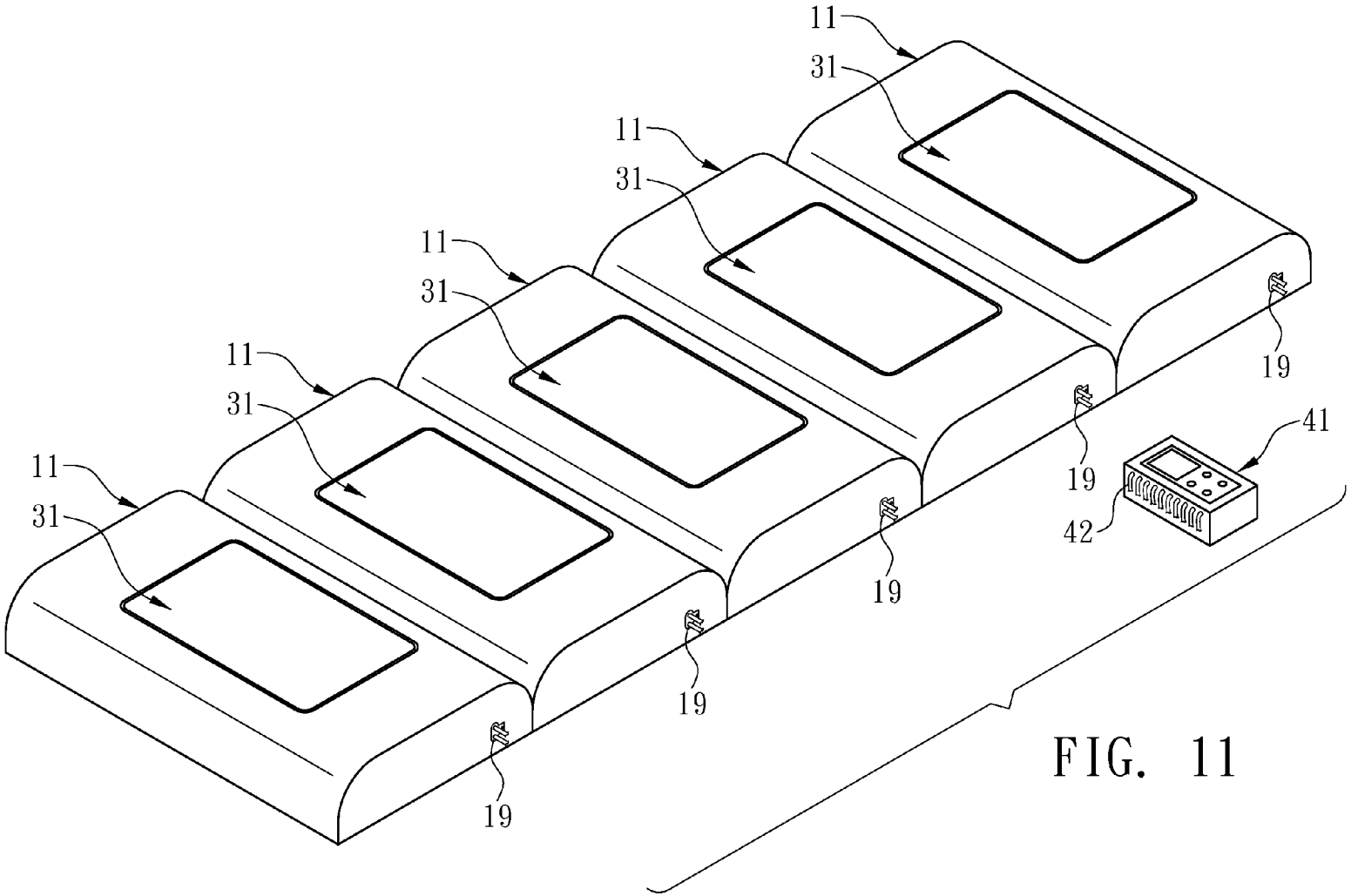
FIG. 11 is a three-dimensional view of the fifth embodiment of the invention.

FIG. 11 shows a fifth embodiment differing from the first embodiment in that the pad 11 is a resting pad. In this embodiment, several pads 11 line up to form a mattress. In this case, the invention can provide soothing effects to the user's head, neck, waist, and legs.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. An air-operated device for better sleep, comprising:

a pad, which has a bottom surface, a top surface, an outer side, an interlayer composed of two sheets stacked together, an accommodating cavity on the top surface and connected to the interlayer, two recesses on both sides of the accommodating cavity and connected to the interlayer, a microphone accommodated in each recess with power lines electrically connecting the microphone to a node on the outer side, and two air vents on the outer side of the pad;

two airbags disposed to each other and inside the accommodating cavity and connected to the interlayer, each air bag has an air pipe connected to one air vent;

an action pad disposed in the accommodating cavity; and a controller, which has two air-transporting pipes and one insertion terminal, externally connecting to the air vents via the air-transporting pipes, and has a pump inside to inflate or deflate the two airbags;

wherein, when the airbags are inflated, the action pad is pushed by the airbags to sway upward; the controller connects to the node via the insertion terminal; and when one of the microphones senses sound, the controller is set to start inflating one of the airbags.

2. The air-operated device for better sleep of claim 1, wherein the power lines of the microphones are covered with electrically insulating pipes.

3. The air-operated device for better sleep of claim 1, wherein the top surface of the pad is a concave surface and the top surface of the action pad is formed with also a concave surface corresponding to the pad and a user's back head.

4. The air-operated device for better sleep of claim 1, wherein when the controller alternately inflates the two airbags, one of the airbags pushes one side of the action pad to sway upward, thereby turning a user's head to the other side.

5. The air-operated device for better sleep of claim 1, wherein the pad and the action pad are added with relaxing flavors or materials that release ions.

6. The air-operated device for better sleep of claim 1, wherein the pad has convex surfaces at front and rear ends and the convex surfaces are formed with wavy and transverse protruding stripes and with several air passages formed between a user's head and the protruding stripes for venting air when the user's head lies thereon.

7. The air-operated device for better sleep of claim 6, wherein the bottom surface of the pad has a structure of loops and hooks strap; one end of a covering body is attached to the bottom surface of the pad, and the other end covers the top surface of the pad along a front end of the pad with both sides hollow; the covering body has a top surface with wavy and transverse protruding stripes, with several air passages formed between the user's head and the protruding stripes for venting air when the user's head lies thereon.

8. The air-operated device for better sleep of claim 1, wherein the accommodating cavity of the pad further has two second airbags disposed above the two airbags; the two second airbags are connected to the interlayer; the two second airbags also have an air pipe connecting to the air vent of the pad; the controller controls the two second airbags to inflate or deflate.

9. The air-operated device for better sleep of claim 8, wherein the controller is set to inflate and deflate the two airbags and the two second airbags in sequence so that a user's head is pushed to rotate along a circumference.

10. The air-operated device for better sleep of claim 1, wherein the pad is a resting pad and a plurality of the pads line up to form a mattress for a user to sleep on.

* * * * *